US007562666B2

(12) United States Patent
Chan

(10) Patent No.: US 7,562,666 B2
(45) Date of Patent: Jul. 21, 2009

(54) MOTORIZED UMBRELLA

(75) Inventor: Ping Chiu Chan, Fanling (HK)

(73) Assignee: Chiaphua Components Limited, Hong Kong Sar (CN)

( * ) Notice: Subject to any disclaimer, the term of this patent is extended or adjusted under 35 U.S.C. 154(b) by 424 days.

(21) Appl. No.: 11/493,543

(22) Filed: Jul. 27, 2006

(65) Prior Publication Data

US 2008/0023053 A1 Jan. 31, 2008

(51) Int. Cl.
*E45B 25/04* (2006.01)
*E45B 17/00* (2006.01)

(52) U.S. Cl. ..... 135/20.3; 135/16; 135/98; 242/395; 248/514

(58) Field of Classification Search ..... 135/16, 135/98, 20.1, 20.3, 43, 74; 493/481–484; 242/512–513, 395; 211/197; 116/173; 248/513, 248/514; 403/91, 93; 473/481–484
See application file for complete search history.

(56) References Cited

U.S. PATENT DOCUMENTS

| | | | | |
|---|---|---|---|---|
| 3,129,715 | A * | 4/1964 | Militano et al. | 135/20.3 |
| 3,311,119 | A * | 3/1967 | Pearlstine | 135/20.3 |
| 3,870,062 | A * | 3/1975 | Medlin | 135/20.3 |
| 4,011,881 | A * | 3/1977 | Becher | 135/20.3 |
| 4,424,824 | A | 1/1984 | Becher | |
| 5,213,122 | A * | 5/1993 | Grady, II | 135/20.3 |
| 5,329,953 | A * | 7/1994 | Becher | 135/31 |
| 5,386,842 | A * | 2/1995 | Becher | 135/20.3 |
| 6,082,383 | A * | 7/2000 | Wilson | 135/41 |
| 6,543,464 | B1 | 4/2003 | Grady, II | |
| 6,913,030 | B1 * | 7/2005 | Chmelik Martinec | 135/20.2 |
| 6,953,043 | B2 * | 10/2005 | Yu | 135/20.1 |
| 7,188,633 | B2 * | 3/2007 | Zerillo | 135/20.3 |
| 2006/0151019 | A1 * | 7/2006 | Lo | 135/20.3 |

FOREIGN PATENT DOCUMENTS

| | | | |
|---|---|---|---|
| DE | 19507967 | A1 * | 9/1996 |
| DE | 10049027 | A1 * | 8/2001 |
| EP | 358043 | A2 * | 3/1990 |
| WO | WO 9119434 | A2 * | 12/1991 |
| WO | WO 2006032162 | A1 * | 3/2006 |

* cited by examiner

*Primary Examiner*—Winnie Yip
(74) *Attorney, Agent, or Firm*—Leydig, Voit & Mayer, Ltd.

(57) ABSTRACT

Radially disposed ribs for supporting the canopy of an umbrella are pivotally connected by a crown mounted on the outer end of a rod. A sleeve is in external sliding relationship with the rod. Struts are pivotally connected to the sleeve, each strut being associated with one of the ribs for splaying the ribs and collapsing them inwardly. A support tube is connected by a coaxial shaft to the rod, and the sleeve is telescopically received in the support tube. The shaft is threaded and rotated by motor, opposing ends of the threaded shaft being supported for rotation in first and second journals fixed within the support tube and the rod, respectively. A threaded nut fixedly connected to the sleeve is engaged with the threaded shaft for moving the sleeve along the rod between extended and retracted positions.

6 Claims, 3 Drawing Sheets

MOTORIZED UMBRELLA

BACKGROUND OF THE INVENTION

The present invention relates to umbrellas and particularly, but not exclusively, to umbrellas the opening and closing of which is motorised.

A typical umbrella is constructed with a support pole carrying at its uppermost end a crown with radiating ribs pivotally connected thereto and a sleeve sliding over the pole with struts being interconnected between the sleeve and the ribs. Various motorised drive mechanisms have been provided to slide the sleeve along the pole in order to cause the struts to splay the ribs attached to the crown upwardly and outwardly.

U.S. Pat. No. 6,543,464 describes an umbrella where the linear movement of the sleeve along the pole is driven by a threaded rod received within a tubular support pole and cooperating with a threaded nut to which the sleeve is fixed. A drawback with this design is the necessity to provide longitudinal openings in the pole for receiving fasteners connecting the internal nut to the external sleeve. Such openings not only detract from the appearance of the umbrella but also permit the entry of foreign matter which is likely to degrade the performance and reduce the working life of the threaded rod and nut.

U.S. Pat. No. 4,424,824 teaches an umbrella having a shaft telescopically received in the support pole and to the outer end of which the crown is fixed such that by retracting the shaft the ribs are splayed outwardly. The flexible member connecting the shaft and sleeve, as well as the cooperating pulley necessary in this umbrella, add considerable complexity and cost to this umbrella. Furthermore, particularly when the umbrella is placed in storage when not in use, it is disadvantageous that the overall length of the umbrella is extended when it is closed.

It is an object of the present invention to overcome or substantially ameliorate at least one of the above disadvantages and/or more generally to provide an improved umbrella.

DISCLOSURE OF THE INVENTION

In one aspect the present invention provides a motorised umbrella comprising:

a rod;

a support tube connected substantially coaxially to the rod;

a plurality of radially disposed ribs, each rib being pivotally connected at one end to an outer end of the rod;

a sleeve telescopically received within the support tube, the sleeve being in external sliding relationship to the rod and moveable relative thereto between an outer extended position and a retracted position;

a plurality of struts pivotally connected between the sleeve and associated ones of the ribs, and drive means including a motor for moving the sleeve between the extended and retracted positions, whereby the struts cause the ribs to splay outwardly of rod in response to movement of the sleeve to the extended position and the struts cause the ribs to collapse inwardly in response to movement of the sleeve to the retracted position.

Preferably the drive means comprises a threaded shaft drivingly engaged with the motor and substantially enclosed in the support tube, opposing ends of the threaded shaft being supported for rotation in first and second journals, the first journal being fixed within the support tube, the second journal being fixed to the rod such that the threaded shaft supports the weight of the rod when the umbrella is upright, and a threaded nut engaged with the threaded shaft and fixedly connected to the sleeve.

Preferably the rod is tubular, the second journal is fixed within an inner end of the rod, and the nut is fixed at an inner end of the sleeve.

A first cushion is preferably fixed at the inner end of the support tube for abutting the yoke at the inner limit of travel of the sleeve and a second cushion fixed at outer end of the sleeve for abutting the crown at the outer limit of travel of the sleeve. Preferably the first cushion is in sliding contact with the sleeve and the second cushion is in sliding contact with the rod for preventing entry of foreign matter.

The drive means preferably further comprises driving and driven bevel gears mounted coaxially with the shaft and connected by a pinion, the pinion having means for engaging a crank handle, the driven bevel gear being drivingly engaged with the threaded shaft and the driving gear being drivingly engaged with a clutch for disconnecting drive from the motor to allow the crank handle to be used for manually rotating the shaft. The clutch preferably includes an actuating member extending transversely through the support tube and having a button portion which, when the clutch is drivingly engaged with the motor, protrudes from the support tube into the path traced in use by rotation of the crank handle engaged with the pinion and which, when the button portion is pushed into the support tube clear of the path traced by the crank handle, acts to disconnect the drive to the motor.

Preferably the means for engaging the crank handle comprises a socket.

In another aspect the invention provides a motorised umbrella comprising:

a rod having inner and outer longitudinal ends;

a support tube;

a threaded shaft having first and second journals mounted at opposing ends thereof to support the shaft for rotation, the first journal being axially fixed to the support tube, the second journal being axially fixed to the rod;

a plurality of radially disposed ribs, each rib being pivotally connected at one end to the outer end of the rod;

a sleeve telescopically received within the support tube, the sleeve being in external sliding relationship to the rod and moveable relative thereto between an extended position and a retracted position;

a plurality of struts pivotally connected between the sleeve and associated ones of the ribs, a motor drivingly engaged with the threaded shaft and substantially enclosed in the support tube, and a threaded nut fixedly connected to the sleeve and engaged with the threaded shaft such that rotation of the shaft moves the sleeve between the extended and retracted positions, whereby the struts cause the ribs to splay outwardly of the rod in response to movement of the sleeve to the extended position and the struts cause the ribs to collapse inwardly in response to movement of the sleeve to the retracted position.

In still another aspect the present invention provides an umbrella comprising:

a rod having inner and outer longitudinal ends;

a support tube;

a threaded shaft having first and second journals mounted at opposing ends thereof to support the shaft for rotation, the first journal being axially fixed to the support tube, the second journal being axially fixed to the rod;

a plurality of radially disposed ribs, each rib being pivotally connected at one end to the outer end of the rod;

a sleeve telescopically received within the support tube, the sleeve being in external sliding relationship to the rod and moveable relative thereto between an extended position and a retracted position;

a plurality of struts pivotally connected between the sleeve and associated ones of the ribs, drive means for rotating the threaded shaft, and a threaded nut fixedly connected to the sleeve and engaged with the threaded shaft such that rotation of the shaft moves the sleeve between the extended and retracted positions, whereby the struts cause the ribs to splay outwardly of the rod in response to movement of the sleeve to the extended position and the struts cause the ribs to collapse inwardly in response to movement of the sleeve to the retracted position.

This invention provides umbrella which is effective and efficient in operational use, and which may be economically constructed. It provides a self-contained motorised umbrella capable of being used remotely from a power supply and the drive means is sealed to increase its working life and reduce the need for maintenance.

BRIEF DESCRIPTION OF THE DRAWINGS

Preferred forms of the present invention will now be described by way of example with reference to the accompanying drawings, wherein.

DESCRIPTION OF THE PREFERRED EMBODIMENTS

Figure 1:
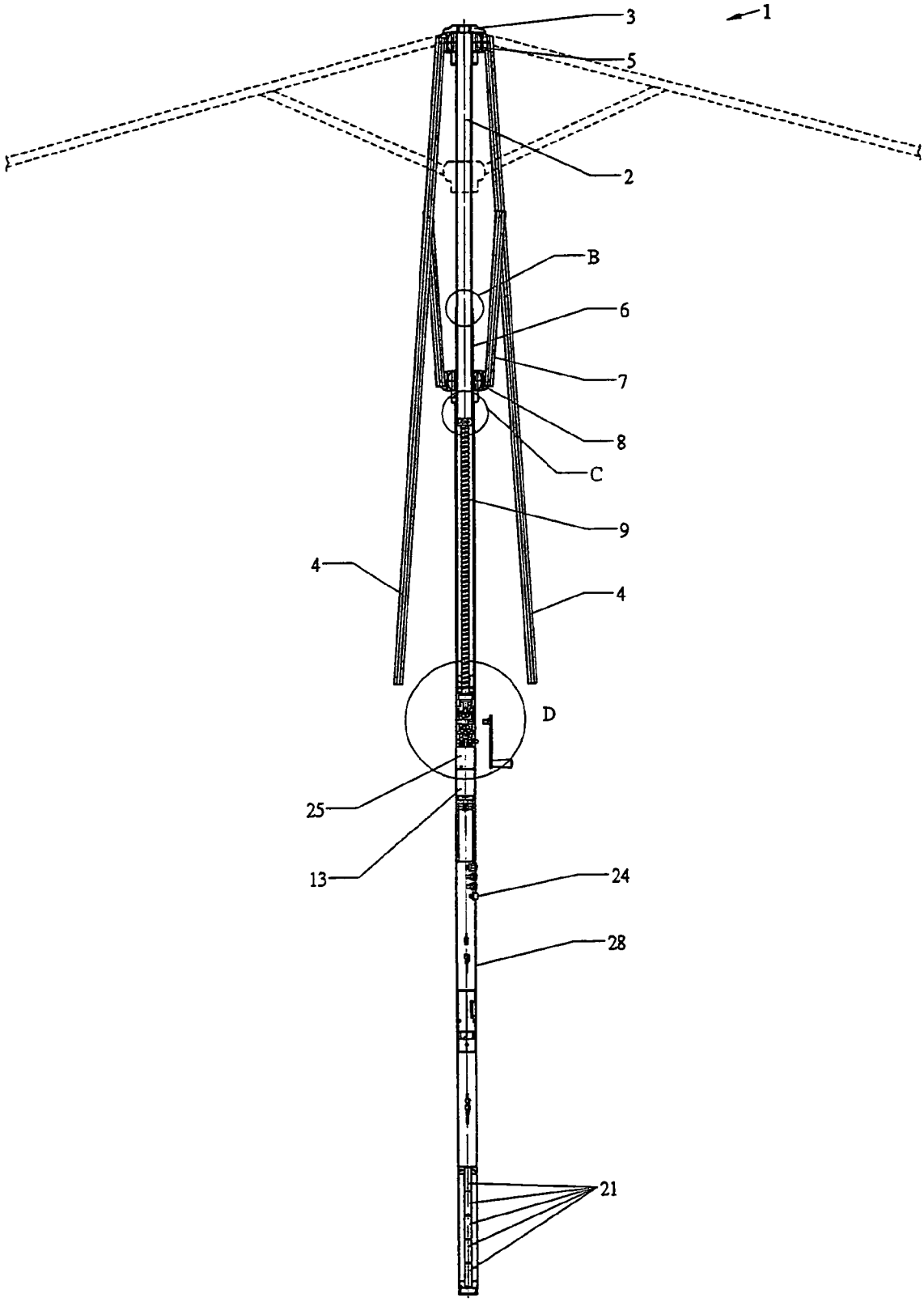
FIG. 1 is a longitudinal section through a pole assembly of a motorised umbrella according to the present invention.
Figure 2:
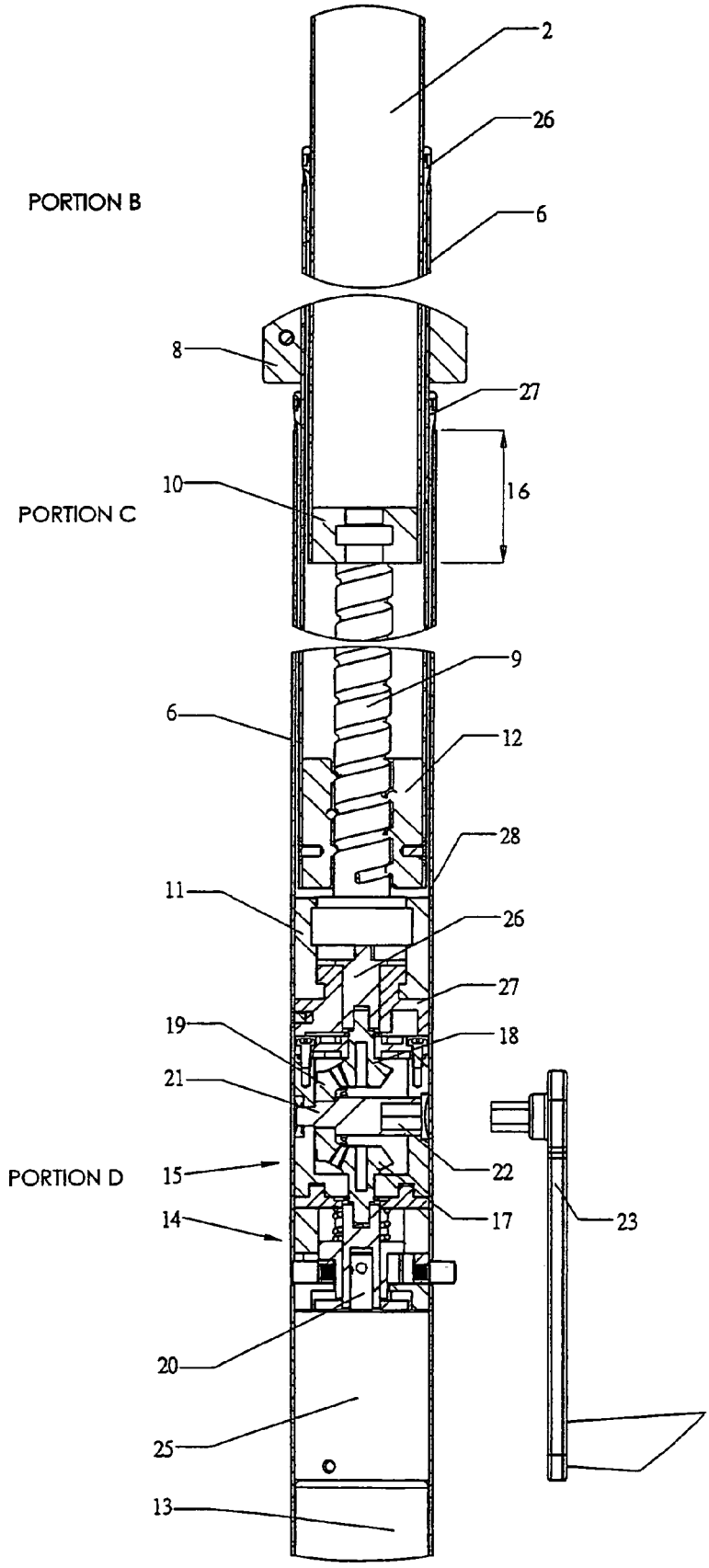
FIG. 2 is an enlarged view of the portions B, C and D of FIG. 1.
Figure 4:
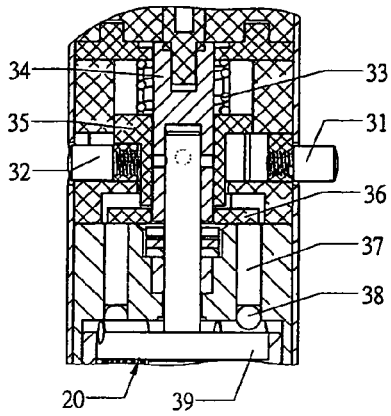
FIG. 4 is an enlargement of scrap view E of FIG. 3.
Figure 5:
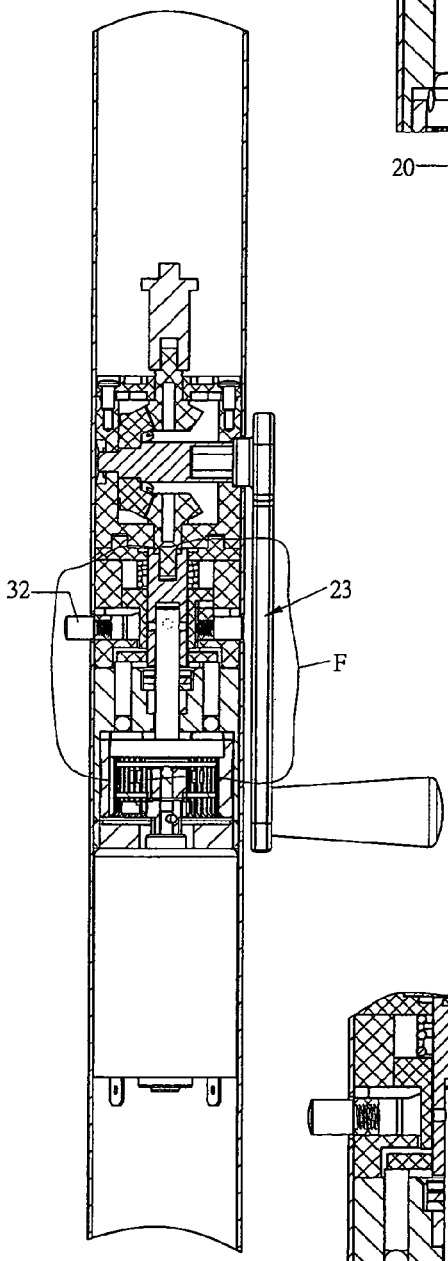
FIG. 5 is an enlarged view of the transmission of portion D of FIG. 1 with the clutch in a released position.
Figure 3:
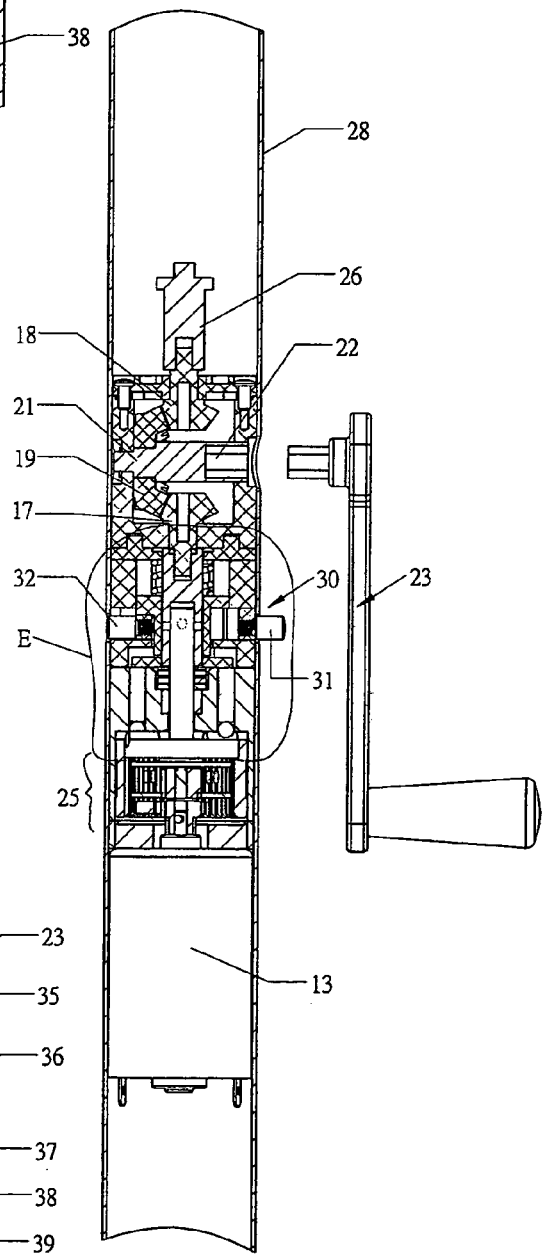
FIG. 3 is an enlarged view of the transmission of portion D of FIG. 1 with the clutch in an engaged position.
Figure 6:
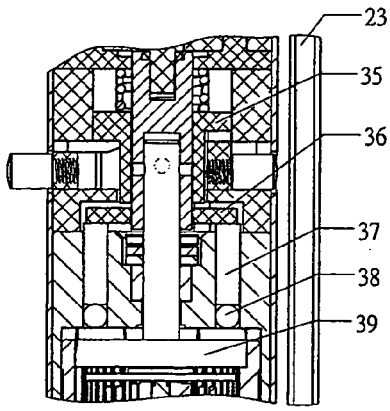
FIG. 6 is an enlargement of scrap view F of FIG. 5.

Referring to FIGS. 1 and 2, a motorised umbrella 1 includes an upright rod 2 having a crown 3 fixed at an outer end thereof. A plurality ribs 4 for supporting the umbrella canopy (not shown) are connected at one end to the crown 3 by pivots 5 to extend radially from the rod 2. A sleeve 6 is in external sliding relationship to the rod 2 received therein. The sleeve 6 is moveable relative to the rod 2 between the inner retracted position shown and an extended (upper) position.

Note that the terms "inner" and "outer" are used to describe relationships relative to both of the two longitudinally opposing ends of the central post assembly of the umbrella. The references in brackets relate to the upright orientation shown in FIGS. 1 and 2 and are added for clarity.

A plurality of struts 7 are pivotally connected between a yoke 8 fixed to the sleeve 6, each strut 7 being connected to an associated one of the ribs 4. When moving the sleeve 6 from the retracted position to the extended position, the struts 7 cause the ribs 4 to splay outwardly of rod 2 (shown in dashed outline). The struts 7 cause the ribs 4 to collapse inwardly in response to movement of the sleeve 6 to the retracted position.

The umbrella 1 is supported by a support tube 28 which, for instance, may be received in an aperture in a table, or the like. A shaft 9 connects the inner end of the rod 2 to the inner (upper) end of the support tube 28. The rod 2, shaft 9 and support tube 28 are mounted coaxially with the sleeve 6. Mounted at opposing ends of the shaft 9 are journals 10, 11 fixed to the rod 2 and support tube 28 respectively, to prevent axial movement of the rod 2 relative to the support tube 28 while allowing rotation of the shaft 9 relative to the support tube 28 and rod 2. The shaft 9 thus supports the weight of rod and the assembly carried on the rod when the umbrella is upright. The rod 2 is tubular and the journal 10 fixed in the inner end of the rod 2 receives one end of the shaft 9. The other end of the shaft 9 is supported for rotation in a journal 11 fixed within the support tube 28.

As best seen in FIG. 2, the inner end of the rod 2 is received within the inner (upper) end of the support tube 28, the support tube 28 overlapping the rod 2 by dimension 16. Extending axially out from the outer end of the sleeve 6 is an annular sleeve cushion 26 which avoids a sharp impact from contact with the crown 3 at the outer limit of travel. Since it also in sliding contact with the rod 2, the sleeve cushion 26 also serves as a seal to prevent entry of foreign matter. A support tube cushion 27 is fixed at the inner end of the support tube 28 for abutting the yoke 8 at the inner limit of travel of the sleeve 6 and sealing between the sleeve 6 and support tube 28.

For reciprocating the sleeve 6 the shaft 9 is externally screw threaded for engagement with a nut 12 fixed within an inner end of the sleeve 6. The shaft 9 is rotated by a motor 13, firstly through a primary gearbox 25, a clutch 14 and then a secondary gearbox 15. The primary gearbox 25 serves to reduce the speed and increase the torque supplied to the clutch 14. The primary gearbox 25 is mounted within the support tube 28 coaxially with the adjacent motor 13. The clutch 14 and secondary gearbox 15 cooperate to allow the umbrella to be operated using either the motor 13 or a crank handle 23 to rotate the shaft 9.

Referring to FIGS. 3-6, the secondary gearbox 15 includes opposing driving and driven bevel gears 17, 18 mounted coaxially with the shaft 9 and connected by a pinion 19. The pinion 19 is mounted on a transversely extending axle 21 and includes a socket 22 for receiving the crank handle 23. The driven bevel gear 18 is connected to the shaft 9 by a coupling shaft 26 mounted for rotation in a bearing sleeve 27 fixed inside the support tube 28.

The clutch 14 is mounted between the output 20 from the primary gearbox 25 and the driving bevel gear 17. The clutch 14 includes an actuating member 30 extending transversely through the support tube 28 and having button portions 31, 32 on opposing ends thereof which protrude from either side of the support tube 28 and are pressed to release and engage the clutch 14 respectively. A spring 33 is mounted (around a hub 34 fixed to the driving bevel gear 17) to bear against an axially sliding collar 35, which through the abutting thrust plate 36 and pins 37 in turn holds balls 38 in recesses in a flange portion 39 of the rotating output 20. In this manner the torque is transmitted through the thrust plate 36 to the hub 34 and thus to the driving bevel gear 17.

When the button portion 31 is pressed (FIGS. 5 and 6) inclined faces (not shown) on the actuating member 30 and collar 35 cooperate to move the collar 35 axially so as to compress the spring 33, thereby allowing the balls 38 to ride up out of the recesses in the output 20, disengaging the drive from the primary gearbox 25. In the released position (FIGS. 3 and 4) the button portion 31 protrudes from the support tube 28 at a position circumferentially aligned with the crank-receiving socket 22. In this manner the button portion 31 projects into the path traced in use by rotation of the crank handle 23 providing a visual clue to the user that, in order to crank the handle 23, it is necessary to press the button 31, not only to release the clutch but to allow the handle 23 to pass the button 31.

Stacked within the support tube 28, below the motor 13 are five rechargeable batteries 21 for powering the motor. A socket 24 in the support tube 28 is provided for plugging in a power supply (not shown) for charging the batteries 21.

Aspects of the present invention have been described by way of example only and it should be appreciated that modifications and additions may be made thereto without departing from the scope thereof.

The invention claimed is:

1. A motorised umbrella comprising:

a rod having inner and outer longitudinal ends;

a support tube;

a threaded shaft supported by journals for rotation relative to the support tube and the rod;

a plurality of radially disposed ribs, each rib being pivotally connected at one end to the outer longitudinal end of the rod;

a sleeve telescopically received within the support tube, the sleeve being in external sliding relationship with the rod and moveable relative to the rod, between an extended position and a retracted position;

a plurality of struts pivotally connected between the sleeve and associated ones of the ribs;

a motor drivingly substantially enclosed in the support tube;

a threaded nut fixedly connected to the sleeve and engaged with the threaded shaft such that rotation of the shaft moves the sleeve between the extended and retracted positions, the struts causing the ribs to splay outwardly of the rod in response to movement of the sleeve to the extended position, and the struts causing the ribs to collapse inwardly in response to movement of the sleeve to the retracted position;

a driving bevel gear mounted coaxially with the threaded shaft;

a clutch for transmitting a driving force between the motor and the driving bevel gear, when engaged;

a driven bevel gear drivingly engaged with the threaded shaft and coaxial with the driving bevel gear:

a crank handle having a drive part; and a pinion transmitting torque between the driving and driven bevel gears and including a socket for releasably receiving the drive part of the crank handle in a complementary fit so that manual rotation of the crank handle turns the pinion and rotates the threaded shaft, after disengaging the clutch so the motor is disconnected from the driving bevel gear.

2. The motorised umbrella of claim 1 including:

a first cushion fixed at an inner end of the support tube for abutting a yoke at an inner limit of travel of the sleeve; and a second cushion fixed at an outer end of the sleeve for abutting a crown at an outer limit of travel of the sleeve.

3. The motorised umbrella of claim 2 wherein the first cushion is in sliding contact with the sleeve and the second cushion is in sliding contact with the rod for preventing entry of foreign matter.

4. The motorised umbrella of claim 1 wherein the clutch includes an actuating member extending transversely through the support tube and having first and second button portions on opposing ends, when the clutch is engaged to transmit the driving force between the motor and the driving bevel gear, the first button portion protrudes from the support tube into a path traced by rotation of the crank handle, and when the first button portion is pushed into the support tube, clear of the path traced by the crank handle, the actuating member disconnects the drive between the motor and the driving bevel gear.

5. The motorised umbrella of claim 1 wherein the journals include first and second journals mounted substantially at opposing ends of the threaded shaft, the first journal being axially fixed to the support tube, the second journal being axially fixed to the rod.

6. The motorised umbrella of claim 5 wherein the rod is tubular, the second journal is fixed within an inner end of the rod, and the threaded nut is fixed at an inner end of the sleeve.

* * * * *